United States Patent [19]

Domges et al.

[11] 4,087,033

[45] May 2, 1978

[54] APPARATUS FOR OPENING FILM CASSETTES

[75] Inventors: Günther Dömges, Oberhaching; Hartmut Scheller, Munich; Helmut Zangenfeind, Puchheim, all of Germany

[73] Assignee: AGFA-Gevaert, A.G., Leverkusen, Germany

[21] Appl. No.: 706,214

[22] Filed: Jul. 19, 1976

[30] Foreign Application Priority Data

Jul. 31, 1975 Germany ..... 2534196

[51] Int. Cl.[2] ..... B26F 3/00

[52] U.S. Cl. ..... 225/1; 225/2; 225/93; 225/96.5

[58] Field of Search ..... 225/1, 93, 96.5, 103, 225/2; 29/200 D

[56] References Cited

U.S. PATENT DOCUMENTS

| | | | |
|---|---|---|---|
| 3,411,682 | 11/1968 | Leader et al. | 225/93 |
| 3,494,519 | 2/1970 | Koehler | 225/93 |
| 3,587,954 | 6/1971 | Pierce | 225/93 |
| 3,722,055 | 3/1973 | D'Ercole et al. | 225/93 X |
| 3,827,588 | 8/1974 | Gnage et al. | 225/93 X |
| 3,883,054 | 5/1975 | Butschek | 225/93 |

*Primary Examiner*—Frank T. Yost
*Attorney, Agent, or Firm*—Michael J. Striker

[57] ABSTRACT

Apparatus for opening substantially rigid synthetic plastic film cassettes of the type having a pay-out section and a film take-up section which are connected by a film-guiding web section of U-shaped cross-section, has first instrumentalities which engage and immovably hold the take-up section, and second instrumentalities which exert upon the pay-out and/or web sections a force sufficient to displace these sections relative to the take-up section to an extent adequate to cause the cassette to crack open.

11 Claims, 2 Drawing Figures

APPARATUS FOR OPENING FILM CASSETTES

BACKGROUND OF THE INVENTION

The present invention relates to an apparatus for opening film cassettes in general, and more particularly to an apparatus for opening substantially rigid synthetic plastic film cassettes. Still more particularly, the apparatus is particularly suitable for opening synthetic plastic film cassettes of the type having a pay-out section and a take-up section which are connected by a film guiding web section of substantially U-shaped cross-section.

Amateur films of all kinds, be it films used for still pictures or films used for motion pictures, are seldom developed at home any more. They are now almost exclusively developed in larger or smaller photographic laboratories. In such laboratories, economy of operation is of course of considerable importance. Insofar as cassette-type films are concerned, such economy of operation is enhanced by the fact that the larger laboratories usually have apparatuses which automatically remove film from the cassette and wherein the removed films are successively connected to one another, i.e. by adhesive means, so that a long chain of individual film strips is obtained which are then also automatically processed in the processing equipment.

In smaller laboratories the rather complicated and expensive apparatuses for extracting the film from the cassette and for connecting successive films to one another are usually not economically feasible, especially since the individual films are usually separately developed in these smaller laboratories. Such smaller laboratories still require an apparatus for opening the film cassettes so as to permit extracting of the film, but such an apparatus should be very much simpler, less complicated and less expensive than the automatic equipment used on the larger laboratories. Even in the larger laboratories, however, such a simple and less complicated type of apparatus is desirable, as long as it is capable of opening up the film cassette even if the trailing leader of the film has been pulled out of the pay-out section and into the take-up section, since the automatic equipment for extracting the film will operate only if some of the film or at least the trailing leader on the film still extends out of the take-up section and is therefore accessable, usually on the U-shaped web section which connects the take-up section and the pay-out section of a film cassette.

The prior art has proposed an arrangement for cracking or breaking open a film cassette, wherein a chisel-like member is utilized which is made to penetrate through a seam of the cassette, i.e. a seam at which two parts of the synthetic-plastic cassette have been bonded together, and which member is tilted normal to the plane of the seam after penetrating into the seam so as to lever the two parts of the cassette apart and permit access to the film.

Another prior-art proposal suggests using a chisel-like member having a width corresponding substantially to the width of the film. This member is inserted into the slot which is formed in synthetic-plastic film cassettes between the take-up section and the web section, and the member is then tilted so that its tip which has been inserted through the slot travels in an arcuate path and levers off the web section and a part of the take-up section in order to permit access to the film in the interior of the latter.

The prior-art proposals suffer, however, from the disadvantage that damage to the film by the chisel-like member can never be reliably precluded. At the very least the exposed film end may be bent, scratched or torn, so that further handling becomes difficult, for example securing of the film end to a preceding or succeeding film strip. Also, this levering-off requires the exertion of a relatively significant force so that the apparatuses according to the prior art must be constructed in a relatively complicated and/or expensive manner.

However, these are not the only disadvantages of this prior-art equipment. It has been found that there is danger of injury to the hands of an operator, as the operations must be carried out in a dark room so that the apparatus cannot be visually observed. Also, a special clamping device must be utilized in each prior-art apparatus of this type for holding the cassette while it is being opened. This requires an additional operation on the part of the operator and of course further complicates and makes more expensive the overall construction of the apparatus.

SUMMARY OF THE INVENTION

Accordingly, it is an object of the present invention to avoid the disadvantages of the prior art.

More particularly, it is an object of the present invention to provide an apparatus for opening substantially rigid synthetic-plastic film cassettes, which is not possessed of the aforementioned disadvantages.

An additional object of the invention is to provide such an apparatus which permits simple and rapid opening of a film cassette for extraction of the film.

Another object of the invention is to provide such an apparatus which is simple and inexpensive in its construction and which is very easy to operate and does not pose any danger of injury to a user or danger of damage to the film.

A further object of the invention is to provide a method of opening a synthetic-plastic film cassette.

In keeping with these objects, and with others which will become apparent hereafter, one feature of the invention resides in a method of breaking-open synthetic-plastic material film cassettes of the type having a take-up secton and a spaced pay-out section connected by a web section of substantially U-shaped cross-section. Briefly stated, this method comprises the steps of fixedly retaining the take-up section against movement, and exerting upon at least one of the other sections a force acting in a sense tending to displace the other section relative to the take-up section, whereby to stress the cassette and crack it open.

It is clear that the present invention does not require the use of chisel-like members for levering open the cassette, but that instead the cassette is cracked open simply by exerting a force upon it which causes it to come apart. Because of this, the danger that the fingers of an operator might be caught between the chisel-like member and the cassette of an injury might result, is eliminated. Further, the possibility of film damage is precluded. What actually happens when resort is had to the present invention, is that the cassette will open essentially along the seams along which its components have previously been bonded together, so that the film take-up spool can be removed from the take-up section without damage and without difficulty.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

Figure 2:
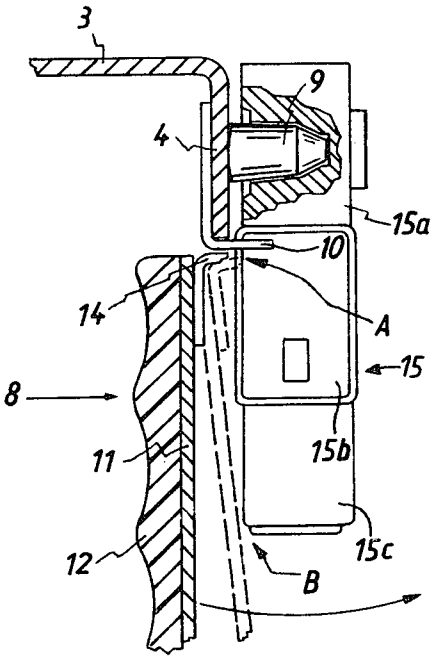
FIG. 2 is a fragmentary cross-section through the apparatus of FIG. 1, with the cassette in place and ready for opening.
Figure 1:
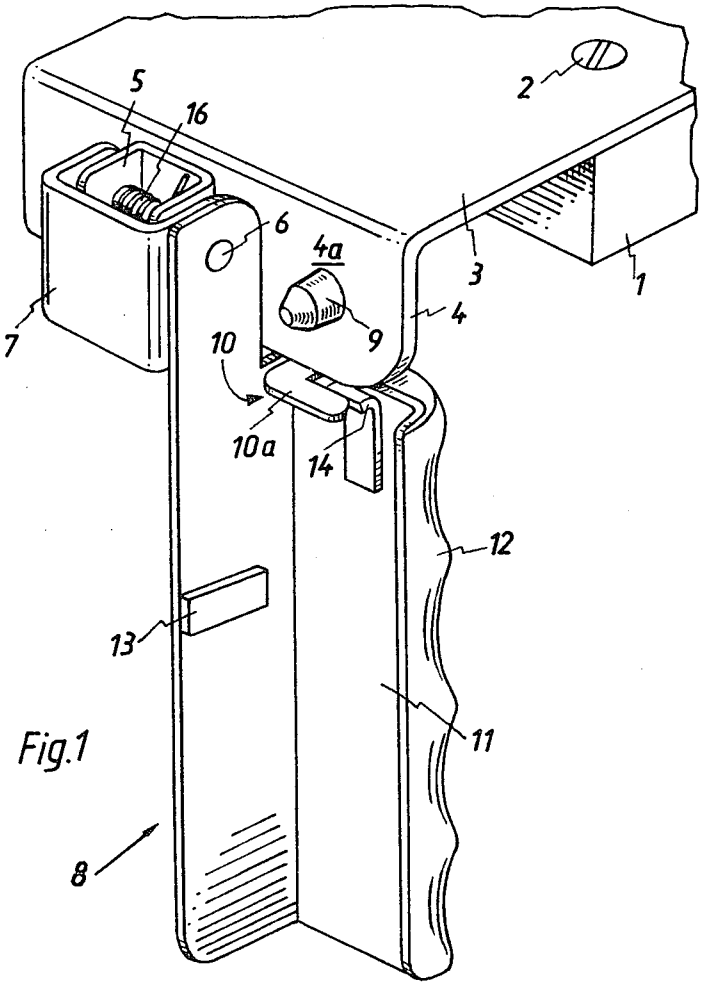
FIG. 1 is a perspective view illustrating one embodiment of an apparatus according to the present invention.

DESCRIPTION OF THE PREFERRED EMBODIMENTS:

FIGS. 1 and 2 show a single exemplary embodiment of the invention. Reference numeral 1 identifies a table or other support structure on which a plate 3 is mounted by means of screws 2. The plate 3 has a downwardly extending angled lip 4 the surface 4*a* of which carries a console 5 that is secured to it in a suitable manner, e.g. by welding, by means of a screw or the like (not shown). The console has two arms between which there is journalled a shaft 6 having end portions extending outwardly of these arms and on which a U-shaped member 7 is pivotably mounted. Also mounted on the shaft 6, adjacent the outer side of one of the arms of the U-shaped member 7 and rigid with the member 7 for movement with the same on the shaft 6, is a lever 8 which will be described subsequently.

The surface 4*a* also is provided with a projection 9 having dimensions so selected that it can be precisely received in the recess formed in the hub of a cassette take-up section (see FIG. 2), i.e. the recess into which the appropriate part of a camera film-advancing mechanism normally extends. Also mounted on the lip 4 (compare FIGS. 1 and 2) is angled holding member 10 having a hook-shaped portion 10*a* which extends beneath the lower edge of the lip 4. The arm 10*a* is spaced forwardly of the surface 4*a* by such a distance that the film-guiding web section (of U-shaped cross-section) 15*b* of a film cassette 15 can enter into the space between the surface 4*a* and the arm 10*a*.

As mentioned before, the member 7 carries a lever 8 which, as FIGS. 1 and 2 both show, extends downwardly from the member 7 and which is configurated to have a U-shaped receiver 11, i.e. a space in which a cassette may be received. The outer side of the lever 8 is formed as a hand grip 12, i.e. is provided with indentations for the fingers of an operator. When a cassette 15 is mounted on the apparatus, so that the projection 9 extends into the recess in the take-up hub of the take-up section 15*a* of the cassette, the cassette is thereafter pivoted (in clockwise direction in FIG. 1), until it enters the receiver 11 and engages an abutment 13 (which can also be omitted) that may be provided on the inner side of the receiver 11 and which assures that the cassette 15 extends substantially parallel to the elongation of the lever 8. As this takes place, the web section 15*b* enters in part into the space between the surface 4*a* and the arm 10*a*, becoming located between the arm 10*a* and an angle member 14 which is mounted on the lever 8 in the receiver 11 and which may have a cutting edge so positioned that during operation it contacts the cassette 15 slightly below the arm 10*a*, as shown in FIG. 2.

In operation, which will be explained with reference to FIG. 2 wherein the lever 8 is shown in its rest position in solid lines and at the beginning of its movement to its operated position in broken lines, the operator grips a cassette 15, preferably with his right hand, and inserts it into the apparatus so that the projection 9 enters into the recess in the take-up hub of the cassette, or more particularly of the take-up section 15*a* thereof. At this time, the cassette will extend more or less horizontal. Thereafter, the operator pivots the cassette in clockwise direction (in FIG. 1) until it enters the receiver and a portion of the web section 15*b* enters into the space between the surface 4*a* and the member 14 on the one side and the arm 10*a* on the other side. The cassette is now in position to be opened.

Thereafter, the operator grips the handgrip 12, holding his thumb onto the cassette 15, and pivots the lever 8 from the solid-line position of FIG. 2 to and beyond the broken-line position of FIG. 2, in the direction of the indicated arrow. The lip 4, the projection 9 and the arm 10*a* cooperate to hold the take-up section 15*a* of the cassette immobile. However, the pay-out section 15*c* is engaged at the location B (see FIG. 2) by the lever 8 and a force is exerted upon it in the direction of the arrow in FIG. 2, thus tending to displace the pay-out section 15*c* and the web section 15*b* in the direction indicated by the arrow, relative to the stationary take-up section 15*a*. This causes the cassette to crack at its weakest point intermediate the take-up section 15*a* and the pay-out section 15*c*, usually and predominantly at the inner (at the left-hand side of FIG. 2) arm of the web section 15*b* which, as will be recalled, is of U-shaped cross-section.

Of course, if left to chance the cracking might not always occur at the desired location and in the desired manner. This is avoided, however, by the presence of the member 14 which engages the web section 15*b* adjacent the take-up section 15*a* and cooperates with the arm 10*a*, thus assuring that it is in this region of the cassette 15 where the cracking will take place. Because of this cooperation between the arm 10*a* and the member 14, which act in effect as blade and counter-blade, only a relatively small force is required to obtain cracking of the cassette material. It is, incidentally, advantageous if the cooperation between the arm 10*a* and the member 14 in the region A (FIG. 2) i.e. their action upon the cassette 15, takes place slightly before the lever 8 engages the pay-out section 15*c* at B and exerts the deflecting force upon the cassette 15.

In any case, as previously indicated, displacement of the lever 8 further towards the right in FIG. 2 beyond the broken-line position causes the cassette 15 to crack open along the seams which connect the synthetic-plastic parts of the cassette together, such cassettes usually having been made of at least two components that are either heat welded or bonded by means of an adhesive along the aforementioned seams. The upper part of the cassette now falls off, the cracking taking place particularly in the area of the take-up section 15*a*, and the spool of film in the interior of the section 15*a* is now exposed for removal. The operator need then merely release the lever 8 which returns to its starting position under the influence of gravity.

The invention assures that the film cassette is attacked at the weakest cross-section area thereof, so that only a relatively small force is required to crack open the cassette. It also assures that a particular region, namely the region A of FIG. 2, is predetermined at which the cracking begins so that an especially strong force acts precisely upon those seams of the cassette which must crack open in order to provide ready access to the spool of film in the take-up section 15*a*. An operator can carry out the entire operation with a single hand and within the space of only a few seconds and will thereafter be able to readily and quickly remove the film for further processing.

The disclosed invention is susceptible of many modifications which are all considered to be encompassed within the scope of the appended claims. Thus, for example, the lever 8 might be returned from operated position to rest position not under the influence of gravity alone, but by means of a biasing arrangement, for example a spring 16 which is shown in FIG. 1 and which acts between the console 5 and the member 7 and has two projecting ends (one shown) acting upon the console 5 and the member 7, respectively, and permanently urging the lever 8 to the rest position shown in FIGS. 1 and 2.

The arm 10*a* might have a different configuration, as might the lever 8 with the receiver 11. The members 5 and 7 could be configurated differently from what is illustrated and the abutment 13 could be omitted. It is also possible to omit the member 14, but for the reasons explained above it is preferred to utilize this member to obtain the described advantages resulting from its presence.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An apparatus for opening substantially rigid elongated synthetic-plastic film cassettes, having transversely spaced longitudinally extending lateral face portions, particularly cassettes having a film pay-out section and a film take-up section which are connected by a film-guiding web section of U-shaped cross-section, comprising a support; first means for engaging a first portion of a cassette and for retaining said cassette against movement relative to said support; and second means movable relative to said support and said cassette for exerting upon a second portion of said cassette, at a location spaced from said first cassette portion, a force acting transverse to the elongation of the cassette in direction from one toward the other of said lateral face portions and sufficient to displace said second cassette portion relative to said first cassette portion and thereby to crack open said cassette.

2. An apparatus as defined in claim 1, wherein said first portion is the take-up section of the cassette, and said second cassette portion is constituted by said pay-out and web sections of the cassette, said first means comprising engaging portions which engage and immobilize said take-up section.

3. An apparatus as defined in claim 2, wherein said second means comprises force-transmitting portions which engage at least one of said pay-out and web sections for transmitting said force thereto.

4. An apparatus for opening substantially rigid synthetic-plastic film cassettes, particularly cassettes having a film pay-out section, a film take-up section spaced therefrom in a given direction and a film-guiding web section of U-shaped cross-section connecting said pay-out and take-up sections, all of said sections having lateral faces extending substantially parallel to said directions, said apparatus comprising first means for fixedly anchoring said take-up section and including engaging portions which engage and immobilize the same; and second means, comprising force-transmitting portions which engage the lateral face of at least one of said pay-out and web sections for transmitting thereto a force sufficient to displace said pay-out and web sections relative to said take-up section and to thereby crack open said cassette.

5. An apparatus as defined in claim 4, said force-transmitting portions comprising a lever, and a shaft mounting said lever for pivoting movement about an axis.

6. An apparatus as defined in claim 5, said take-up section having a recess; said first means comprising a projection receivable in said recess and extending transversely of said axis.

7. An apparatus as defined in claim 6, said first means further comprising a support on which said projection is carried, and a holding member on said support and defining with the same a space into which said web section is insertable, when said projection is received in said recess, by pivoting the cassette about said projection in a given direction.

8. An apparatus as defined in claim 7, said support having a free edge and said holding member including an L-shaped arm projecting beyond and spaced from said free edge and defining therewith said space which is open opposite to said direction for entry of said web section.

9. An apparatus as defined in claim 5, wherein said lever has a first portion configurated as a handgrip, and a second portion forming with said first portion a receiver shaped to accommodate substantially the pay-out and web sections of a cassette.

10. An apparatus as defined in claim 9; further comprising a support carrying a projection insertable into a recess of said take-up section of a cassette, said support having a free edge; and a member mounted on said support and having a cutting edge extending beyond said free edge, said cutting edge being so located as to engage said web section in response to pivoting of said lever to said operating position and said second portion being configurated to engage said pay-out section in response to said pivoting but only after said cutting edge engages said web section.

11. A method of breaking open synthetic-plastic material film cassettes of the type having transversely spaced longitudinally extending lateral face portions and including a take-up section and a longitudinally spaced pay-out section connected by a web section of substantially U-shaped cross-section, comprising the steps of engaging said take-up section and retaining said cassette against movement; and exerting upon at least one of the other sections of the thus retained cassette a force acting transversely of the longitudinal spacing of said take-up and pay-out sections in direction from one toward the other of said lateral face portions and in a sense tending to displace said other section relative to said take-up section, whereby to stress said cassette and crack it open.

* * * * *